US009116510B1

(12) United States Patent
Justin et al.

(10) Patent No.: US 9,116,510 B1
(45) Date of Patent: Aug. 25, 2015

(54) MICRO ATOMIC AND INERTIAL MEASUREMENT UNIT ON A CHIP SYSTEM

(71) Applicant: The Boeing Company, Chicago, IL (US)

(72) Inventors: Joseph E. Justin, Corona, CA (US); Robert J. Atmur, Whittier, CA (US)

(73) Assignee: The Boeing Company, Chicago, IL (US)

( * ) Notice: Subject to any disclaimer, the term of this patent is extended or adjusted under 35 U.S.C. 154(b) by 252 days.

(21) Appl. No.: 13/707,488

(22) Filed: Dec. 6, 2012

(51) Int. Cl.
*G04F 5/14* (2006.01)

(52) U.S. Cl.
CPC ..... *G04F 5/14* (2013.01)

(58) Field of Classification Search
CPC ..... G04F 5/14; H03L 7/26; H03B 17/00
USPC ..... 331/94.1, 3; 73/5 R, 5.4, 5.6 A, 504.12, 73/514.27
See application file for complete search history.

(56) References Cited

U.S. PATENT DOCUMENTS

2012/0013411 A1* 1/2012 Nishida ..... 331/94.1
2012/0235754 A1* 9/2012 Chindo ..... 331/94.1
2013/0327146 A1* 12/2013 Meyer et al. ..... 73/514.27

* cited by examiner

*Primary Examiner* — Joseph Chang
*Assistant Examiner* — Jeffrey Shin
(74) *Attorney, Agent, or Firm* — Felix L. Fischer

(57) ABSTRACT

A chip scale atomic clock (CSAC) accelerometer incorporates a case in which a cesium vapor resonance cell is carried. An optical laser is mounted in the case and emits a laser beam through the resonance cell. The laser is modulated by a microwave signal generator. A photon detector mounted in the case receives photons emitted by cesium atoms in the resonance cell and provides a frequency output representative of interference of energy levels of the emitted photons including momentum changes due to acceleration.

20 Claims, 6 Drawing Sheets

MICRO ATOMIC AND INERTIAL MEASUREMENT UNIT ON A CHIP SYSTEM

BACKGROUND INFORMATION

1. Field

Embodiments of the disclosure relate generally to the field of inertial measurement units (IMU) and more particularly to an IMU employing orthogonally mounted chip-scale atomic clocks (CSAC) in combination with 3-axis solid-state accelerometers and gyroscopes.

2. Background

Guidance, navigation and control (GN&C) of vehicles such as aircraft, missiles and spacecraft requires accurate sensing of time, acceleration in multiple axes and angular rate data for determination of relative motion of the vehicle. The existing solutions use electromechanical gyros, accelerometers, and clock references, in combination with GPS (Global Positional System) aiding in certain instances. Modern GN&C research has also focused on atomic wave clocks, Microelectromechanical Systems (MEMS), solid-state gyros, solid-state gyros, and solid-state accelerometers. However, in certain instances GPS signals might be denied, and solid-state sensors and MEMS lack the long-term stability and accuracy desired for accurate GN&C.

It is therefore desirable to provide a system and method for GN&C which provides long-term stability and accuracy without the requirement for GPS availability. It is also desirable that the system be incorporated in chip scale devices.

SUMMARY

Embodiments disclosed herein provide a chip scale atomic clock (CSAC) accelerometer which incorporates a case in which a cesium vapor resonance cell is carried. An optical laser is mounted in the case and emits a laser beam through the resonance cell. The laser is modulated by a microwave signal generator. A photon detector mounted in the case receives photons emitted by cesium atoms in the resonance cell and provides a frequency output representative of interference of energy levels of the emitted photons including momentum changes due to acceleration.

A mini-IMU chip (MIC) incorporates at least three orthogonally mounted CSACs each CSAC providing an output representative of interference of energy levels of emitted photons in that CSAC. The CSACs are mounted in a package with a processing unit receiving the output from each CSAC.

The embodiments provide a method for acceleration measurement wherein a first frequency output is received from a first chip scale atomic clock (CSAC) having a first axis and a second frequency output is received from a second CSAC having a second axis orthogonal to the first axis. A frequency shift is determined between the first frequency output and second frequency output. An acceleration in the first or second axis may then be determined based on the frequency shift.

The features, functions, and advantages that have been discussed can be achieved independently in various embodiments of the present disclosure or may be combined in yet other embodiments further details of which can be seen with reference to the following description and drawings.

DETAILED DESCRIPTION

Embodiments disclosed herein provide a single micro system device functioning as a high accuracy inertial measurement unit (IMU). A Micro-IMU-Chip (MIC) co-integrates atomic sensors in the form of chip-sized atomic clocks (CSACs) (based upon the atomic physics of cesium atoms) and solid-state inertial sensors (based upon electrometrical laws of inertia and dynamics). Relative shifts in frequency measurements of the CSACs are related to acceleration imposed in each input/measurement axis. This frequency shift can be used to measure the acceleration. A set of three CSACs mounted orthogonally to one another can be used to measure acceleration, as well local gravity, in three axes. On each of the three axes, two CSACs in opposing input axis direction can be used as a refinement to measuring the acceleration vector in each axis. Additionally, the same set or a second set of CSACs in orthogonal configuration will experience a frequency phase shift relative to each other when there is angular rotation. This is due to the relative energy state of the atoms in the resonance cells under angular motion. This frequency shift can be used to measure the angular motion and orientation. The sets of CSACs can be used to measure body angular motion and orientation, as well local earth rate, in three axes. Extracting of the acceleration data and angle data is accomplished via the co-integration of the above sets of CSAC architecture and using associated software computation measurements, determinations, and algorithms. The atomic CSACs are additionally integrated with high performance solid-state sensors of Microelectricalmechanical System (MEMS) grade accelerometers and gyroscopes. The CSACs have very long term stability, range, and performance but the solid-state sensors are quicker to calibrate and turn-on. Therefore, combining the dissimilar physics technology enhances the overall IMU performance. Economy of scale is obtained in the combination of all these instruments into one cube-like, stable, chip-scale IMU. All the combinational algorithms and electronics can be combined on a single processor in the cube.

Figure 1:
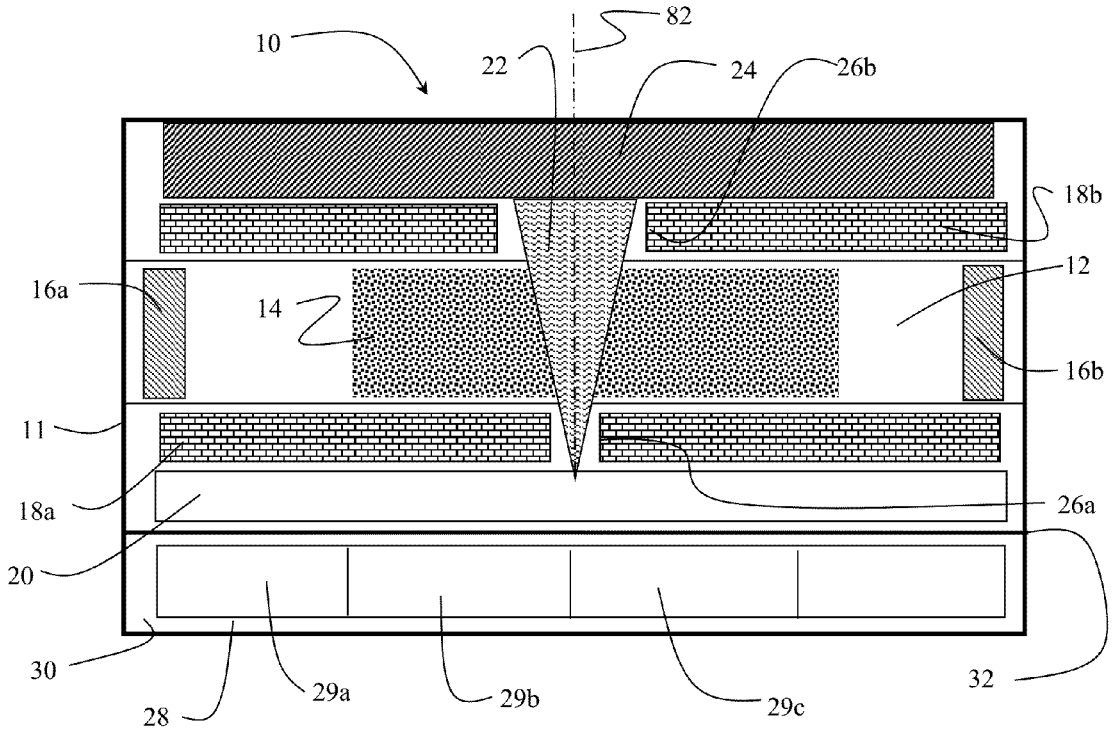
FIG. 1 is a block diagram of a chip scale atomic clock (CSAC) accelerometer.

Referring to the drawings, FIG. 1 shows a CSAC 10 for use as an accelerometer in the MIC embodiments described herein. Contained in a shielded case 11, a resonance cell 12 contains cesium atoms heated to a vapor state (represented notionally as element 14) with heating plates 16*a* and 16*b* on the sides of (or alternatively/additionally, the top and bottom of) the cell. Thermal layers 18*a*, 18*b* are provided for thermal efficiency in the heated resonance cell 12. An optical laser 20, in example embodiments a typical solid-state semiconductor diode laser, provides a laser beam 22 through the resonance cell to a detector such as photodiode 24. Appropriate apertures 26*a* and 26*b* are provided in the resonance cell, thermal layers and heating plates, as required for transmission of the laser beam. Electronics 28 such as power supplies 29*a* and 29*b* for the heater plates and optical laser are provided in a chamber 30 which is separated from the lasing cavity by shielded wall 32. The laser beam 22 shines through the cesium vapor 14 causing excitation in the cesium atoms. A microwave signal generator 29*c* in the electronics 28 modulates the laser. The laser excites the atoms at two different energy levels. Interference between the two levels is detected by the photodiode establishing an atomic clock and that data becomes the parameters of a feedback loop control as will be described in greater detail subsequently. The counted cycles of the microwave oscillator signal as measured by the photodiode determine a timing output for the clock function of the CSAC.

Figure 2:
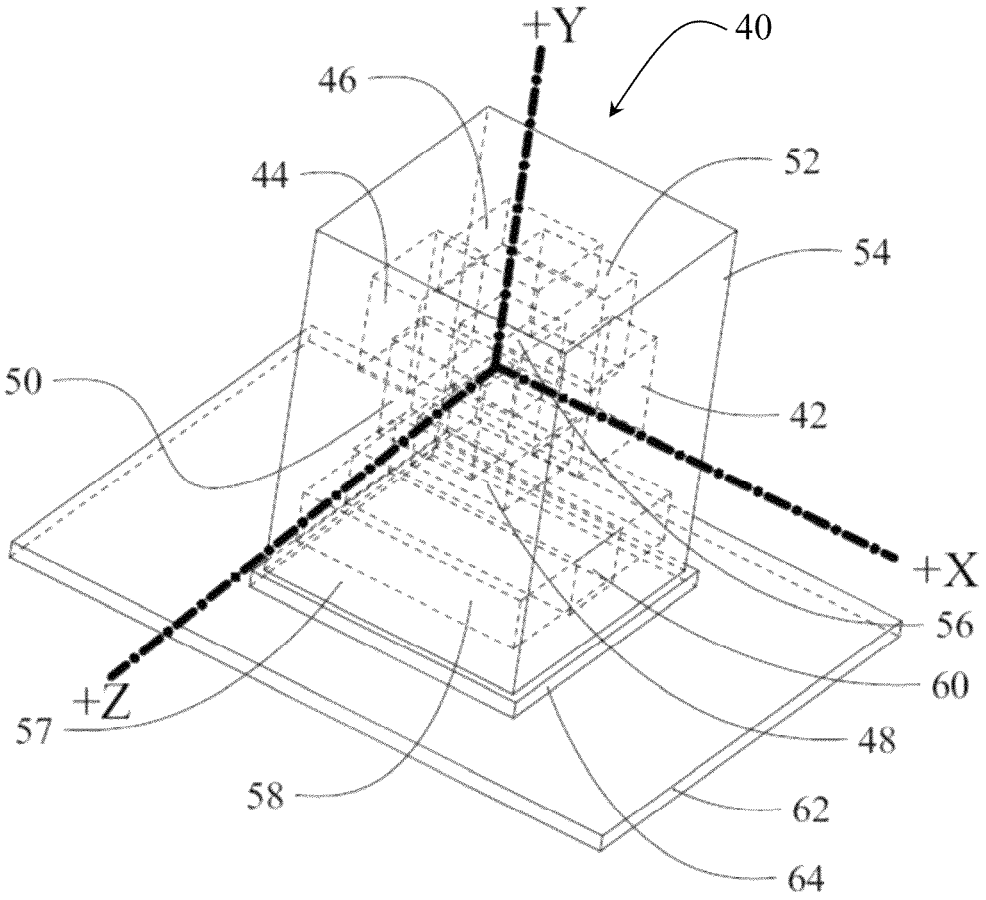
FIG. 2 is an isometric block diagram of a micro IMU chip (MIC) incorporating CSAC pairs on each of three orthogonal axes and solid state accelerometers and gyroscopes.

A MIC 40 is assembled by mounting multiple CSACs 42, 44, 46, 48, 50, 52 in orthogonal orientation, one for the positive and negative direction of each orthogonal axis (i.e. +X axis 42, −X axis 44, +Y axis 46, −Y axis 48, +Z axis 50 and −Z axis 52), in a package 54 as shown in FIG. 2. While both positive and negative axis CSACs are shown in the embodiment in the drawings, in certain embodiments only a single CSAC per axis may be employed. A set of three axis solid state accelerometers and gyroscopes 56 is centrally mounted within the package 54. For an example embodiment a typical MEMS accelerometer and gyro package of silicon-quartz micro-instruments using resonating, oscillating or cantilever structures with beam, fork, disk, or piezo configurations may be employed. An electronics bay 57 houses common electronics 58 for the MIC such as a processing unit 60. In an exemplary embodiment, the MIC package may be approximately 3 to 4 cm square in planform with a height of approximately 6 to 7 cm allowing the MIC to be housed in a volume of only 60 cc to 120 cc. With only a single CSAC per axis a volume of approximately 20 cc may be obtained. The MIC may be mounted to a circuit board 62 with a mating plate 64 for thermal sink performance, electromagnetic interference (EMI) isolation, structural mounting of the housing, and mounting of the CSAC to the next higher level assembly.

Figure 3:
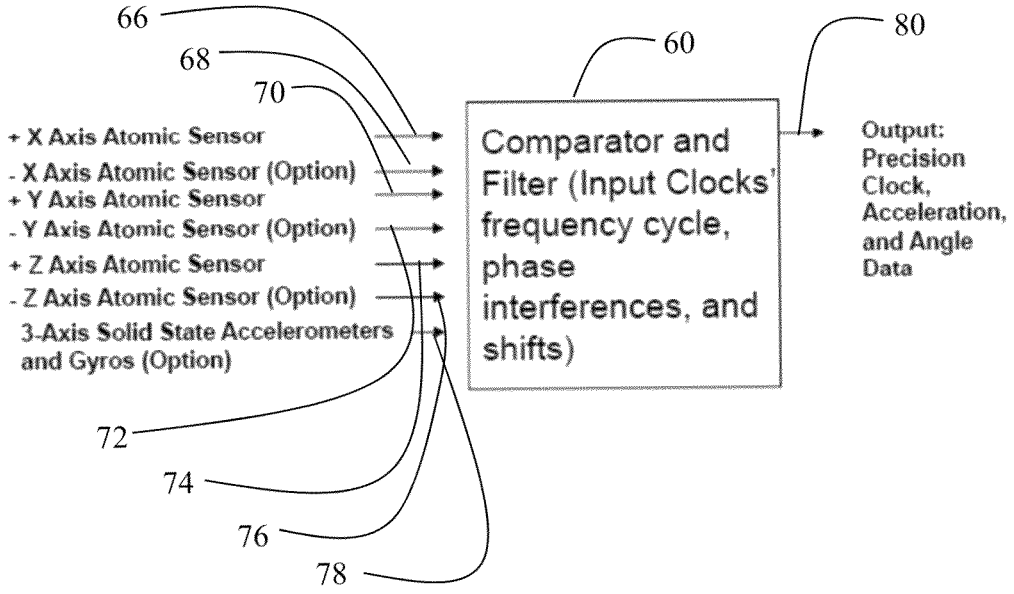
FIG. 3 is a flow diagram of signal inputs to a processing unit with the inertial measurement unit (IMU) output.

IMU data processing for the MIC is accomplished as shown in FIG. 3. Data from the +X axis CSAC sensor 66, −X axis CSAC sensor 68, +Y axis CSAC sensor 70, −Y axis CSAC sensor 72, +Z axis CSAC sensor 74 and −Z axis CSAC sensor 76 and 3-Axis solid state accelerometers and gryoscopes output 78 are received in the processing unit 60 which applies comparator and filter software modules for frequency cycle of the input clocks, phase interferences and phase shifts (created in the CSAC atomic clocks as will be described subsequently) to provide an output 80 having precision clock data, acceleration and angle data. The phase interferences and phase shifts of each of the CSACs are based on momentum exchange to and from the optical field. In all physical reactions momentum must be conserved. Therefore when a photon is emitted by the cesium atoms in the cesium vapor 14 as excited by the laser beam 22 in the CSAC, the frequency of the photon holds all of the energy of the transition and in addition the photon ejection from the atom provides a momentum exchange between the atom and the photon. This is seen in the classic emission/adsorption of gamma rays in cobalt57—and Iron as exemplary of the phenomenon. The photon has a total possible momentum based solely on its frequency by the equation $$P(\text{momentum})=h(\text{planks constant})\nu(\text{frequency})$$

This momentum/energy is relative to the point of emission or absorption and is not intrinsic to the photon itself as determined by Einstein.

In typical cold fountain atomic clocks such as the cesium vapor clock incorporated in the CSAC the intent of having a "cold" fountain is to minimize the distribution of the momentum in the atoms to keep the absorption peak of the atoms to a very narrow range thereby keeping the frequency stable. Due to relativity, atomic clocks run at different frequencies due to different observer velocities (momentum) and acceleration (changes in momentum). This phenomenon of atomic clocks allows acceleration measurements. Starting in a local frame where there is no relative velocity or acceleration between the cold fountain atoms of cesium vapor and the body of the absorption chamber of that clock, the resonance cell 12 in the CSAC, the momentum, P0, needed to allow absorption is constant. This equivalent frequency is produced by the microwave signal modulating the laser 20 and tracked by the photodiode 24. That frequency is divided down to provide a clock output, typically around 20 kHz. For the CSACs employed in the MIC, phase locking of the power supplies for the lasers 20 in all of the CSACs synchronizes the unaccelerated clock outputs. The absorption chamber has a center line 82 (see FIG. 1) around which absorption occurs determined solely by the geometry of the chamber. If atoms are present along this line they will absorb the emitted photons and re-emit them which is detected in the photodiode 24. The frequency at which the absorption and emission occurs is determined by the momentum of the atoms relative to the chamber i.e. the cold fountain.

If acceleration occurs along this absorption line the atoms in the chamber are (floating) disconnected from the chamber and it will force the atomic clock to adjust its frequency to compensate for this relative change in momentum. As new atoms are produced by the fountain of one CSAC while under constant acceleration, a constant frequency shift will be detected and tracked relative to other clocks in CSACs not experiencing the same acceleration along their chamber center line. This difference in frequency is counted to determine the relative acceleration along each chamber axis.

Similarly, rotation around the chamber center line 80 results in relative sinusoidal accelerations in the orthogonal axis to the one being rotated about. Direction and magnitude of acceleration and angular rotation can be directly determined by relative measurement of frequency and phase between the orthogonally mounted CSACs.

Figure 4:
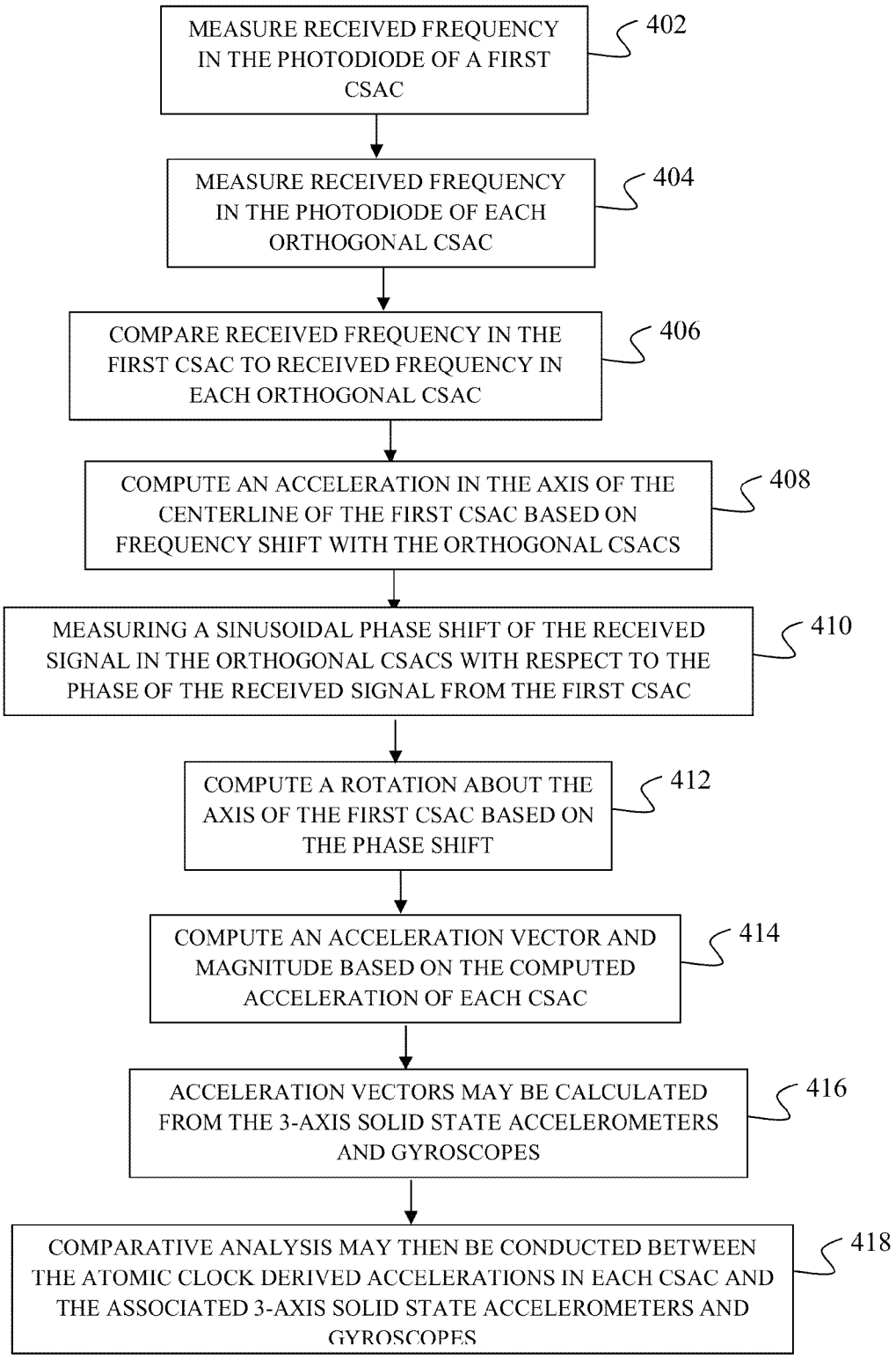
FIG. 4 is a flow chart of a method for employing CSACs for acceleration measurement in a MIC.

Acceleration and angular rotation are therefore calculated in the MIC as shown in FIG. 4 by measuring received frequency in the photodiode of a first CSAC, step 402. The measured frequency will reflect the absorption and emission rate as determined by the momentum of the atoms relative to the chamber as pumped by the laser modulated by the microwave signal generator. Received frequency in the photodiode of each orthogonal CSAC is then measured, step 404. The received frequency in the first CSAC is then compared to received frequency in each orthogonal CSAC, step 406. An acceleration is then computed in the axis of the centerline of the first CSAC based on frequency shift with the orthogonal CSACs, step 408. Measuring a sinusoidal phase shift of the received signal in the orthogonal CSACs with respect to the phase of the received signal from the first CSAC, step 410, allows computing a rotation about the axis of the first CSAC, step 412, based on the phase shift. Computing an acceleration vector and magnitude based on the computed acceleration of each CSAC, step 414, may then be accomplished. The combination of calculations for all three orthogonal CSACs allows determination of earth rate, local gravity, and body linear and angular rate data. Acceleration vectors may be calculated from the 3-Axis Solid State Accelerometers and gyroscopes in the MIC, as is known in the art, step 416.

Comparative analysis may then be conducted between the atomic clock derived accelerations in each CSAC and the associated 3-Axis solid state accelerometers and gyroscopes of the MIC, step 418. While the example configuration of sensors described with respect to the embodiments herein is orthogonal that is not required. The CSACs need not be orthogonal but merely angularly displaced for operability. Similarly, the MEMS accelerometers and gyroscopes need not be orthogonal. A number of angular configurations may be employed.

Figure 5:
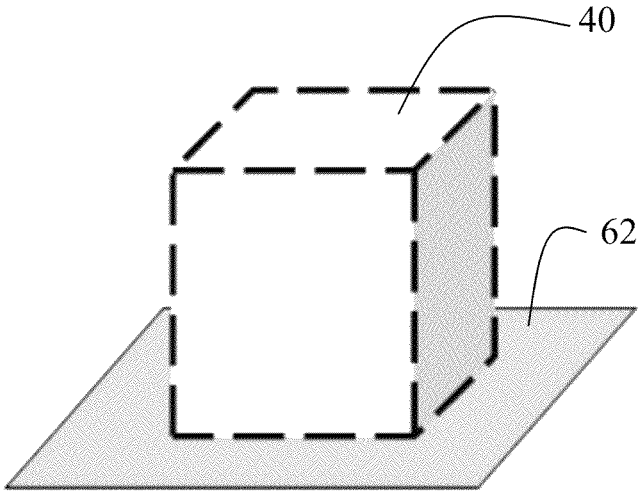
FIG. 5 is a block diagram of an example strap down IMU employing a MIC.
Figure 6:
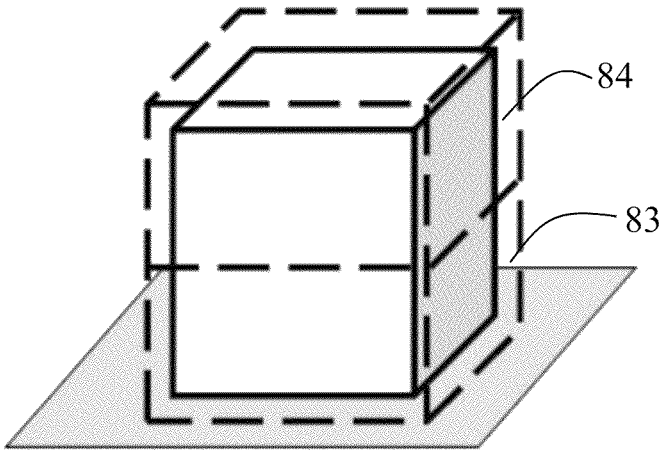
FIG. 6 is a block diagram of a cradle and lid arrangement for mounting of the MIC in the strap down IMU of FIG. 5.
Figure 7:
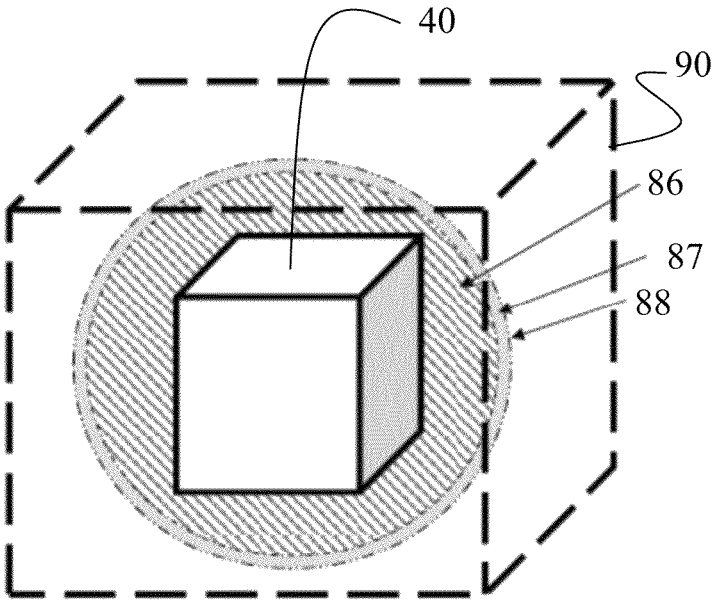
FIG. 7 is a block diagram of a floating ball IMU employing a MIC.
Figure 8:
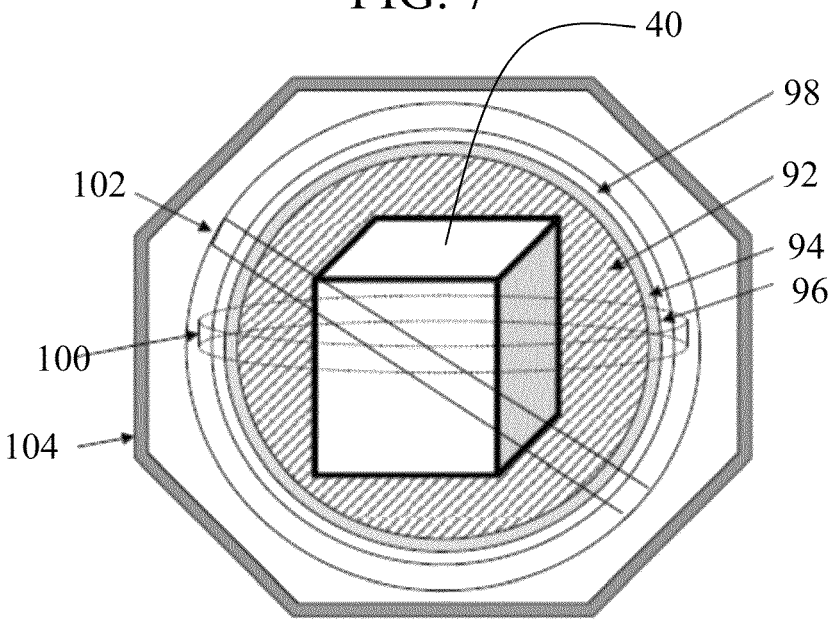
FIG. 8 is a block diagram of a gimbal mounted IMU employing a MIC.

The MIC as described with respect to FIG. 2 may be employed in a number of IMU configurations. As shown in FIG. 5, the MIC 40 as mounted on circuit board 62 may be employed as a strap down IMU. In certain embodiments, a cradle 83 and lid 84 may be employed to mount the MIC 40 to the circuit board for the strap down IMU application as shown in FIG. 6. The lid and cradle may be adapted for shielding, including EMI, radiation, emissions security (TEMPEST), thermal protection and dynamic protection of the MIC. As shown in FIG. 7, the MIC 40 may be supported in a floated ball configuration for coning and sculling control as is known in the art. An inner ball platform 86 directly supporting the MIC 40 is suspended with a gap 87 within an outer ball 88 formed in a container 90 with ball suspension, electrical interfaces and thermal and shield protection. Similarly, the MIC 40 may be supported in a gimbaled shell configuration as shown in FIG. 8 with an inner ball platform 92 supported with a gap 94 by outer ball 96 having ball suspension, electrical interfaces, thermal and shield protection, supported by inner gimbaled shell 98, which is in turn supported by second gimbaled shell 100 and outer gimbaled shell 102. Multiple gimbals may be employed as is known in the art. A housing 104 allows mounting of the IMU in the vehicle platform.

Having now described various embodiments of the disclosure in detail as required by the patent statutes, those skilled in the art will recognize modifications and substitutions to the specific embodiments disclosed herein. Such modifications are within the scope and intent of the present disclosure as defined in the following claims.

What is claimed is:

1. A chip scale atomic clock (CSAC) accelerometer comprising:

a cesium vapor resonance cell;

an optical laser emitting a laser beam through the resonance cell, said optical laser modulated by a microwave signal generator;

a photon detector receiving photons emitted by cesium atoms in the resonance cell and providing a frequency output representative of interference of energy levels of the photons emitted including momentum changes due to acceleration; and, a processing unit receiving the frequency output and determining a frequency shift representative of the acceleration.

2. The CSAC as defined in claim 1 wherein the resonance cell incorporates heater plates to heat the cesium atoms to the vapor state.

3. The CSAC as defined in claim 1 further comprising a thermal layer surrounding the resonance cell.

4. The CSAC as defined in claim 1 further comprising a case incorporating a chamber for electronics, said chamber housing:

a power supply for the laser; and, a power supply for the heater plates.

5. The CSAC as defined in claim 4 wherein the signal generator is mounted in the chamber.

6. The CSAC as defined in claim 3 wherein the thermal layer incorporates at least one aperture for transmission of the laser beam.

7. The CSAC as defined in claim 1 wherein the photon detector is a photodiode.

8. A mini-IMU chip (MIC) comprising:

at least three orthogonally mounted chip scale atomic clocks (CSACs) each CSAC having a photon detector providing a frequency output representative of interference of energy levels of emitted photons in the CSAC;

a package in which the CSACs are mounted; and, a processing unit receiving the output from each CSAC photon detector wherein a frequency shift is used to measure momentum change induced by an acceleration, said processing unit calculating an acceleration vector.

9. The MIC as defined in claim 8 further comprising 3-axis solid state accelerometers and gyroscopes mounted in the package and providing an output to the processing unit.

10. The MIC as defined in claim 8 wherein each CSAC comprises:

a case;

a cesium vapor resonance cell carried in the case;

an optical laser mounted in the case and emitting a laser beam through the resonance cell, said laser modulated by a microwave signal generator; and, a photon detector mounted in the case to receive photons emitted by cesium atoms in the resonance cell and providing the output.

11. The MIC as defined in claim 10 wherein for each CSAC the resonance cell incorporates heater plates to heat the cesium atoms to the vapor state and a thermal layer surrounds the resonance cell, and the case incorporates a chamber mounting electronics including a power supply for the laser, a power supply for the heater plates, and the signal generator.

12. The MIC as defined in claim 8 wherein the MIC is mounted on a printed circuit board as a strap down inertial measurement unit (IMU).

13. The MIC as defined in claim 8 wherein the MIC is mounted in a floated ball.

14. The MIC as defined in claim 8 wherein the MIC is mounted in a gimbaled shell.

15. A method for acceleration measurement comprising:

receiving a first frequency output from a first chip scale atomic clock (CSAC) having a first axis;

receiving a second frequency output from a second CSAC having a second axis orthogonal to the first axis;

determining a frequency shift between the first frequency output and second frequency output;

determining an acceleration in the first or second axis based on the frequency shift.

16. The method of claim 15 further comprising:

determining a phase shift between the first frequency output and the second frequency output; and, determining a rotation about the first axis or second axis based on the phase shift.

17. The method of claim 16 wherein receiving a first frequency output comprises:

modulating a first optical laser in the first CSAC with a microwave signal generator;

exciting cesium atoms in a cesium vapor in a resonance chamber of the first CSAC with a beam from the optical laser; and, detecting a frequency of photon absorption and emission from the cesium atoms in the first CSAC.

18. The method of claim 17 wherein receiving a second frequency output comprises:

modulating a second optical laser in the second CSAC with a microwave signal generator;

exciting cesium atoms in a cesium vapor in a resonance chamber in the second CSAC with a beam from the second optical laser; and, detecting a frequency of photon absorption and emission from the cesium atoms in the second CSAC.

19. The method of claim 18 further comprising:

modulating with a microwave signal generator a third optical laser in a third CSAC having an axis orthogonal to the first axis and the second axis;

exciting cesium atoms in a cesium vapor in a resonance chamber in the third CSAC with a beam from the third optical laser; and, detecting a frequency of photon absorption and emission from the cesium atoms in the third CSAC as a third frequency output;

determining a frequency shift between the first frequency output and the third frequency output and, determining an acceleration in the first axis, second axis or third axis based on the frequency shift.

20. The method as defined in claim 19 further comprising:

determining a phase shift between the first frequency output and the third frequency output; and, determining a rotation about the first axis or third axis based on the phase shift.

* * * * *